US005423525A

United States Patent [19]

Spainhower

[11] Patent Number: 5,423,525

[45] Date of Patent: Jun. 13, 1995

[54] C-CLAMP

[76] Inventor: Rodger D. Spainhower, 15202 N. 8th Dr., Phoenix, Ariz. 85023

[21] Appl. No.: 82,382

[22] Filed: Jun. 28, 1993

[51] Int. Cl.[6] ..... B25B 1/02

[52] U.S. Cl. ..... 269/174; 269/249

[58] Field of Search ..... 269/249, 173–182; 411/433, 437

[56] References Cited

U.S. PATENT DOCUMENTS 686,924 11/1901 Cramer ..... 269/174
1,846,422 2/1932 Hands ..... 269/249
2,156,195 4/1939 Robillard ..... 269/249
2,705,983 4/1955 Guadagna ..... 269/174

FOREIGN PATENT DOCUMENTS 19896 3/1930 Australia ..... 269/249

*Primary Examiner*—Robert C. Watson
*Attorney, Agent, or Firm*—Tod R. Nissle

[57] ABSTRACT

A C-clamp includes a C-shaped body. The body has an anvil end and an internally threaded second end. The second end carries a screw which is used to press a workpiece against the anvil. The second end permits the screw both to be turned through the second end and to be freely pushed through the second end and against the anvil.

13 Claims, 5 Drawing Sheets

C-CLAMP

This invention relates to tools.

More particularly, the invention relates to a C-clamp which includes a C-shaped body have an anvil end and an internally threaded second end carrying a screw used to press a workpiece against the anvil, the second end permitting the screw both to be turned through the second end and to be freely pushed through the second end and against the anvil.

C-clamps are well known in the art. See, for example, U.S. Pat. Nos. 4,582,307 to Wang, 3,599,960 to Phillips, 2,644,498 to Malecki, and 3,425,681 to Wing. The Wang and Wing references disclose C-clamps which include quick release mechanisms that permit the screw in a C-clamp to be freely pushed against the anvil of the C-clamp. These prior art quick release mechanisms have disadvantages. First, each quick release mechanism must be manually operated, which means a user typically must use one hand to operate the quick release mechanism and his other hand to push the screw toward the anvil in the C-clamp. Consequently, the user does not have a hand free to hold the C-clamp or to position a workpiece in the C-clamp. Second, the quick release mechanisms each comprise a spring loaded member which is pivotally mounted on a pin and is moved into and out of engagement with the screw in the C-clamp. When the quick release mechanisms engage the screw and the screw is tightened against a workpiece in the C-clamp, the pin carrying the spring loaded member must bear localized forces representing a large portion of the total magnitude of forces which are generated by tightening the screw against the workpiece. This makes the pin subject to failure.

Accordingly, it would be highly desirable to provide an improved C-clamp which permits a user to control the screw in the C-clamp with one hand to disengage the screw from internal threads in the C-clamp and to push the screw toward the C-clamp anvil, freeing up the user's other hand to hold the C-clamp or to position a workpiece in the C-clamp.

It would also be highly desirable to provide an improved C-clamp which, while permitting the screw in a C-clamp to be disengaged from internal threads in the C-clamp and freely pushed toward the C-clamp anvil, better distributes forces which are generated by tightening the screw against a workpiece in the C-clamp.

Therefore, it is a principal object of the invention to provide an improved C-clamp.

A further object of the invention is to provide an improved C-clamp in which a screw can, with only a single hand, be disengaged from internal threads in the C-clamp and freely pushed toward the C-clamp anvil.

Another object of the invention is to provide an improved C-clamp of the type described which more uniformly distributes the stresses generated when the C-clamp screw is tightened against a workpiece held in the C-clamp.

Still a further object of the is to provide an improved C-clamp of the type described in which the screw can, with a single hand, be freely pushed toward and away from the C-clamp anvil with engaging internal threads in the C-clamp.

These and other, further and more specific objects of the invention will be apparent to those skilled in the art from the following detailed description thereof, taken in conjunction with the drawings, in which.

Briefly, in accordance with my invention, I provide an improved C-clamp. The C-clamp includes a C-shaped body having a first end terminating in an anvil, and a second end. The second end includes a base; first and second opposing members mounted in the base, the first member being internally threaded and pivotally mounted in the base for movement between two operative positions, a first operative position with the first and second members contacting one another and defining an internally threaded aperture, and a second operative position with the first member displaced apart from said second member; and, an opening formed through said base. A screw in the C-clamp includes a foot and extends through the opening and has external thread capable of axially threading through the internally threaded aperture when the first and second members are in the first operative position. The external thread is shaped and dimensioned such that when the first and second members are in the first operative position with the external thread contacting the internally threaded aperture, and with the foot spaced apart from said anvil, the application to the screw of a displacement force acting to displace the foot toward the anvil causes the first member to pivot away from the screw to the second operative position such that the screw can slide intermediate the first and second members upwardly toward the anvil. The second member can be internally threaded and pivotally mounted in the base.

In another embodiment of my invention, I provide an improved C-clamp including a C-shaped body having a first end terminating in an anvil, and a second end. The second end includes a base; first and second opposing internally threaded members pivotally mounted in the base for movement between two operative positions, a first operative position with the first and second members contacting one another and defining an internally threaded aperture, and a second operative position with the first and second members displaced apart from one another; and, an opening formed through the base. A screw in the C-clamp includes a foot and extends through the opening and has external thread capable of axially threading through the internally threaded aperture when the first and second members are in the first operative position. The first and second members are shaped and dimensioned such that when the first and second members are in the first operative position;

when the foot presses a workpiece against the anvil; and, when the foot is further tightened against the workpiece; at least one of the first and second members is forced against the base in a direction away from the anvil, the foot, and the workpiece.

Figure 1:
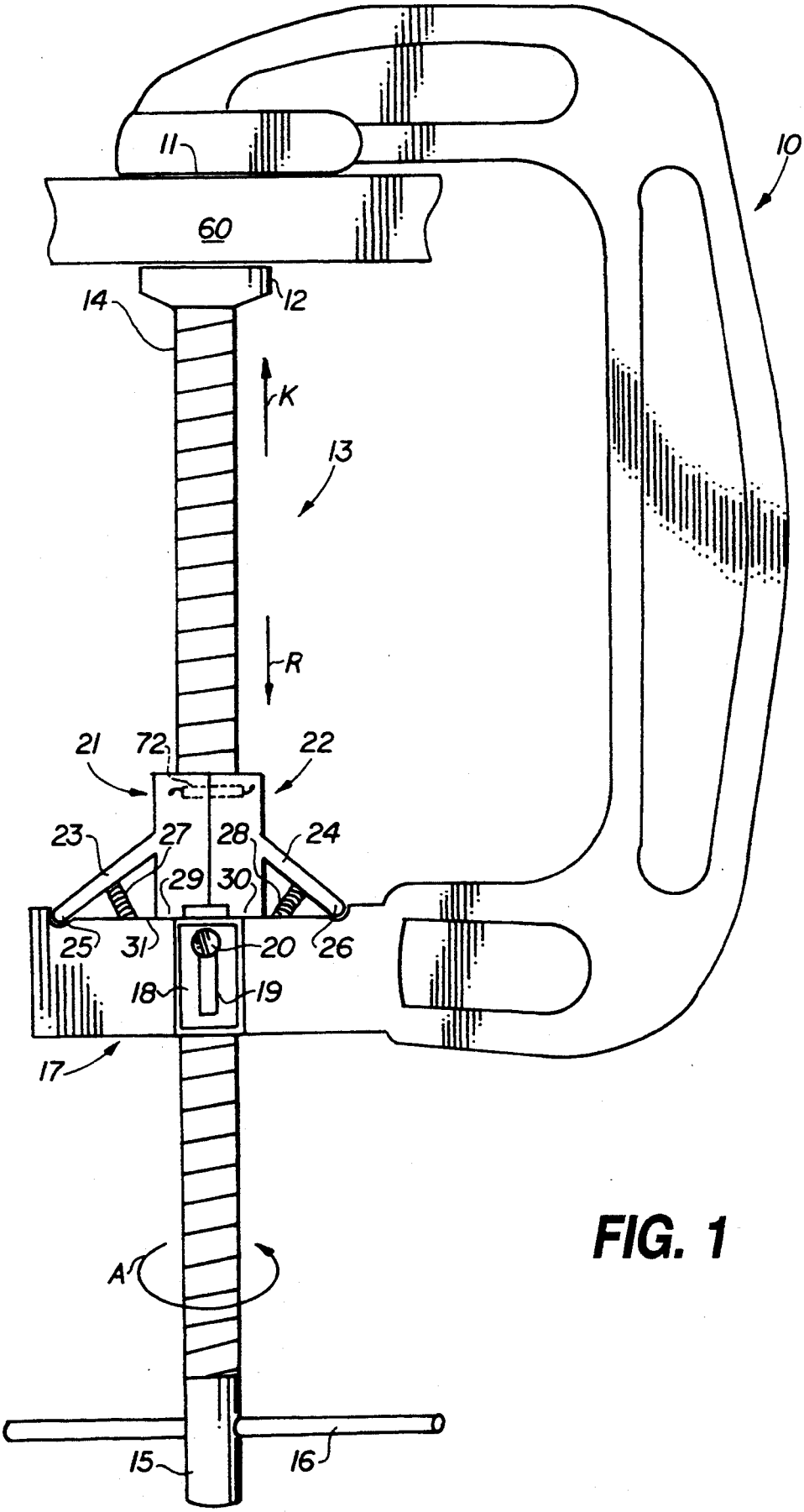
FIG. 1 is a front elevation view illustrating a C-clamp constructed in accordance with the principles of the invention.

Turning now to the drawings, which depict the presently preferred embodiments of the invention for the purpose of illustrating the practice thereof and not by way of limitation of the scope of the invention, and in which like reference characters refer to corresponding elements throughout the several views, FIG. 1 illustrates a C-clamp constructed in accordance with the invention and including a C-shaped body 10, a first end terminating in an anvil 11, and a second end. The second end includes a base 17, and, first 21 and second 22 opposing members pivotally mounted in the base.

Figure 2:
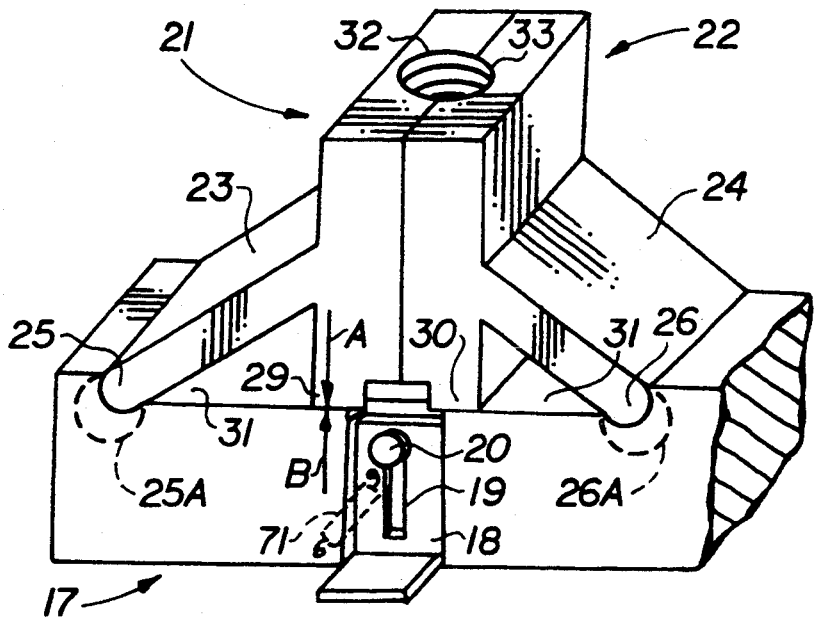
FIG. 2 is an enlarged perspective view of the lower end of the C-clamp of FIG. 1 illustrating the mechanism used to quickly release the C-clamp screw from engagement with internal threads in the C-clamp.
Figure 3:
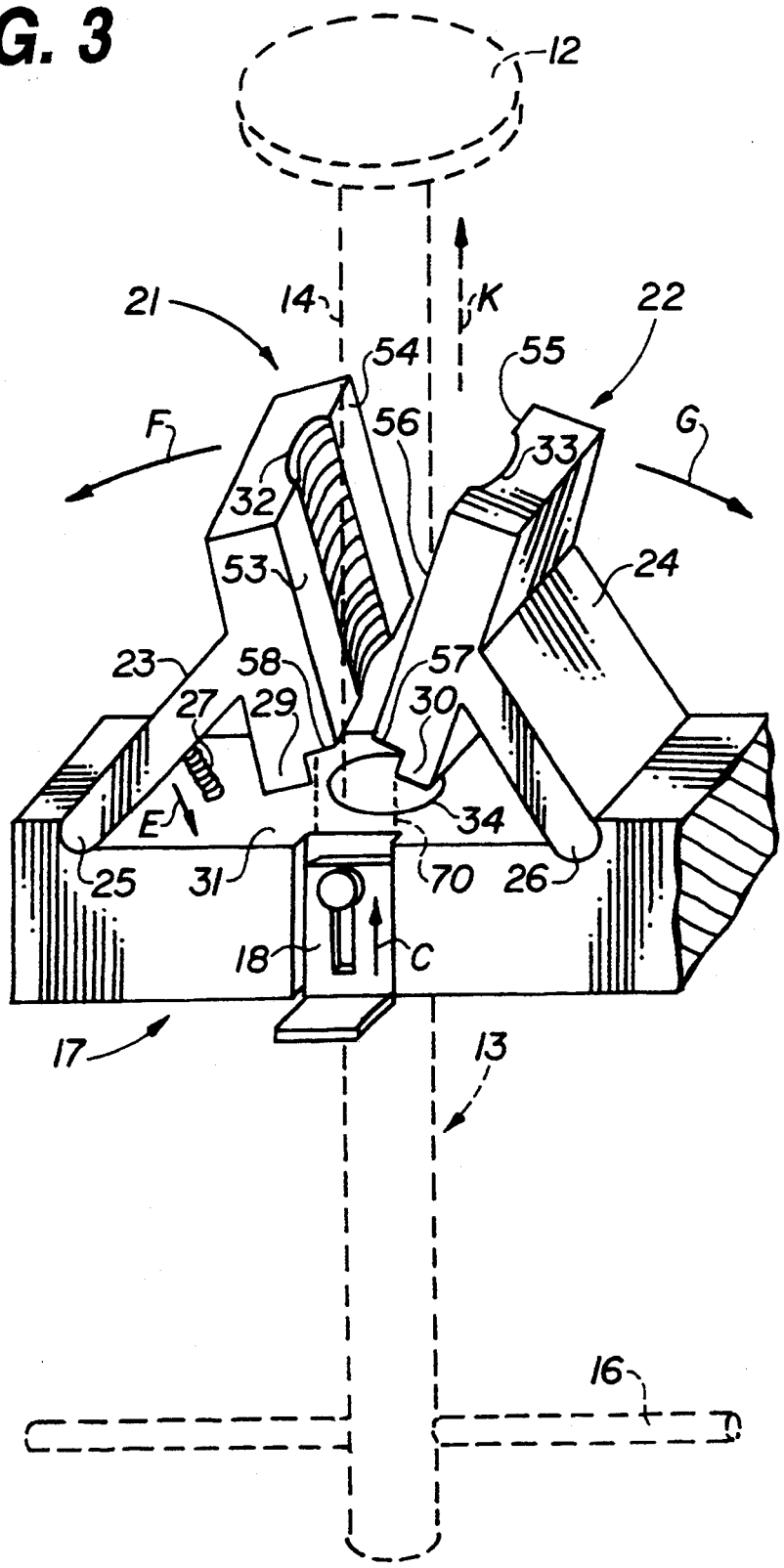
FIG. 3 is a perspective view of the portion of the C-clamp of FIG. 2 illustrating the mode of operation thereof.

The first member 21 includes an internal thread 32 (FIG. 2) formed in a semi-cylindrical surface and includes an arm 23 having a rounded end 25 pivotally mounted in base 17 such that member 21 can be moved between at least first and second operative positions. In the first operative position, illustrated in FIG. 2, the first 21 and second 22 members contact one another and define an internally threaded aperture comprised of internal threads 32 and internal thread 33 (FIG. 2). The second operative position is illustrated in FIG. 3. In the second operative position, member 21 is pivoted in the direction of arrow F to move from the first operative position of FIG. 2 to the second operative position illustrated in FIG. 3.

The second member 22 includes an internal thread 33 (FIG. 2) formed in a semi-cylindrical surface and includes an arm 24 having a rounded end 26 pivotally mounted in base 17 such that member 22 can be moved between at least two operative positions. In the first operative position, illustrated in FIG. 2, the first 21 and second 22 members contact one another and define an internally threaded aperture comprised of internal thread 32 and internal thread 33 (FIG. 2). Face 54 of member 21 (FIG. 3) contacts face 55 of member 22. Face 53 of member 21 contacts face 56 of member 22. The second operative position of member 22 is illustrated in FIG. 3. To move member 22 to the second operative position, member 22 is pivoted from the first operative position (FIG. 1) in the direction of arrow G to the second operative position illustrated in FIG. 3.

Ends 25 and 26 can be shaped and dimensioned in any manner which permits ends 25 and 26 to pivot with respect to base 17. For example, as indicated by dashed lines 25A and 26A in FIG. 2, ends 25 and 26 can be shaped to prevent ends 25 and 26 from readily being pulled free from base 17.

Tensioned spring 27 (FIG. 1) is connected at one end to arm 23 and at the other end to surface 31 of base 17. Spring 27 functions to pull arm 23 and member 21 toward surface 31 of base 17. In FIG. 1, tensioned spring 27 pulls arm 23 and member 21 toward surface 31 and presses foot 29 of member 21 against surface 31 in the direction indicated by arrow A in FIG. 2. Base 17 counteracts B the force acting in the direction of arrow A. Tensioned spring 28 is connected at its upper end to arm 24 and at its lower end to surface 31 of base 17. Spring 28 functions to pull arm 24 toward surface 31 of base 17 and to force member 22 against member 21 in the manner illustrated in FIGS. 1 and 2. In FIG. 1, tensioned spring 28 pulls arm 24 and member 22 toward surface 31 and presses foot 30 of member 22 against surface 31. Base 17 also counteracts the downward force of foot 30 against base 17. As would be appreciated by those of skill in the art, springs 27 and 28 can be replaced by a variety of spring configurations which cause members 21 and 22 to function in the manner desribed herein. For example, a spring 72 extending from member 21 to member 22 can be utilized.

Screw 13 slidably extends through cylindrical opening 34 (FIG. 3) formed through in base 17. Screw 13 includes foot 12, externally threaded portion 14 with thread 45, lower end 15, and turn rod 16 extending through end 15. When rod 16 and portion 14 are rotated in the direction of arrow A in FIG. 1, screw 13 moves in the direction of arrow K and foot 12 is pressed against workpiece 60. When foot 12 is pressed against workpiece 60, feet 29 and 30 are pressed against surface 31 of base 17 and faces 53 and 54 of member 21 are pressed against faces 56 and 55, respectively, of member 22.

Figure 7:
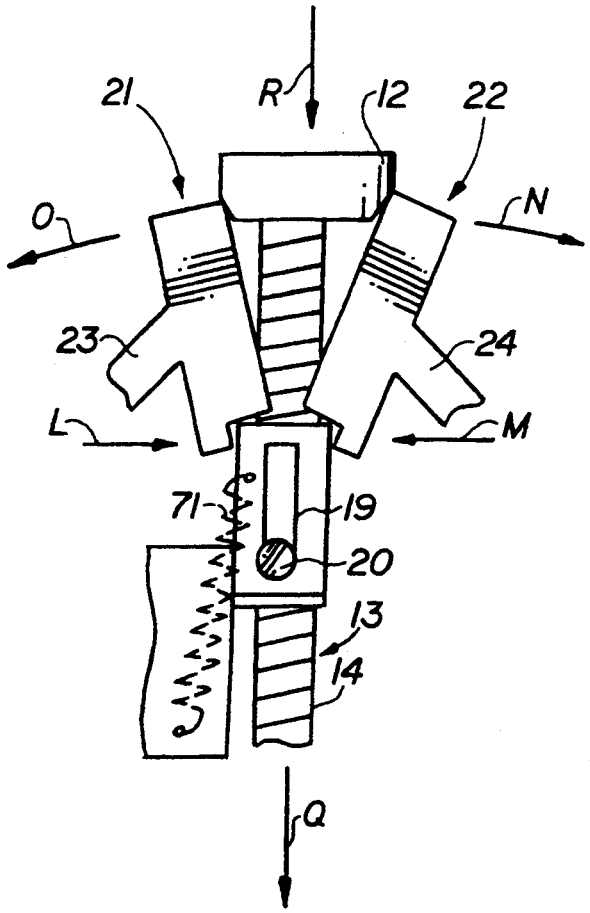

L-shaped latch 18 includes slot 19. Slot 19 freely slides over pin 19 fixedly connected to base 17. In FIG. 1, the force of gravity maintains latch 18 in the position shown. If desired, a spring 71 or other means can be utilized to bias latch 18 in the position shown in FIG. 1. In FIG. 2, tensioned spring 71 maintains latch 18 in the position shown and resists movement of latch 18 in an upward direction toward feet 29 and 30. In FIG. 7, latch 18 has been upwardly slid from the position of FIG. 1 to the position illustrated in FIG. 7 and is maintaining members 21 and 22 in the open second operative position shown in FIGS. 3 and 7. Spring 71 generates a force which pulls on latch 18 the direction of arrow Q. When latch 18 and members 21, 22 are in the position shown in FIG. 7, tensioned springs 27 and 28 pull members 21 and 22 toward one another and cause members 21 and 22 to generate on the upper corners of latch 18 the forces indicated by arrow L and M. Forces L and M function to compress and frictionally engage the upper edges of latch 18 between members 21 and 22 to prevent latch 18 from sliding downwardly over pin 20 under the force of gravity in the direction of arrow Q. Forces L and M also function to compress and engage the upper edges of latch 18 to prevent latch 18 from being pulled downwardly over pin 20 by a spring 71 in the direction of arrow Q. When members 21 and 22 are in the second operative position illustrated in FIG. 7, screw 13 can be slid freely between members 21 and 22 and through opening 34 in the opposite directions indicated by arrows K and R. When screw 13 is slid downwardly in the direction of arrow R to the position shown in FIG. 7, the sloped lower surfaces of foot 12 contact and force apart members 21 and 22 a small distance in the directions indicated by arrows 0 and N, respectively. When members 21 and 22 are so forced apart by foot 12, the distance between the lower portions of members 21 and 22 is slightly increased such that members 21 and 22 no longer contact latch 18 and latch 18 slides downwardly over pin 20 under the force of gravity in the direction of arrow Q to the position illustrated in FIG. 1.

Figure 5:
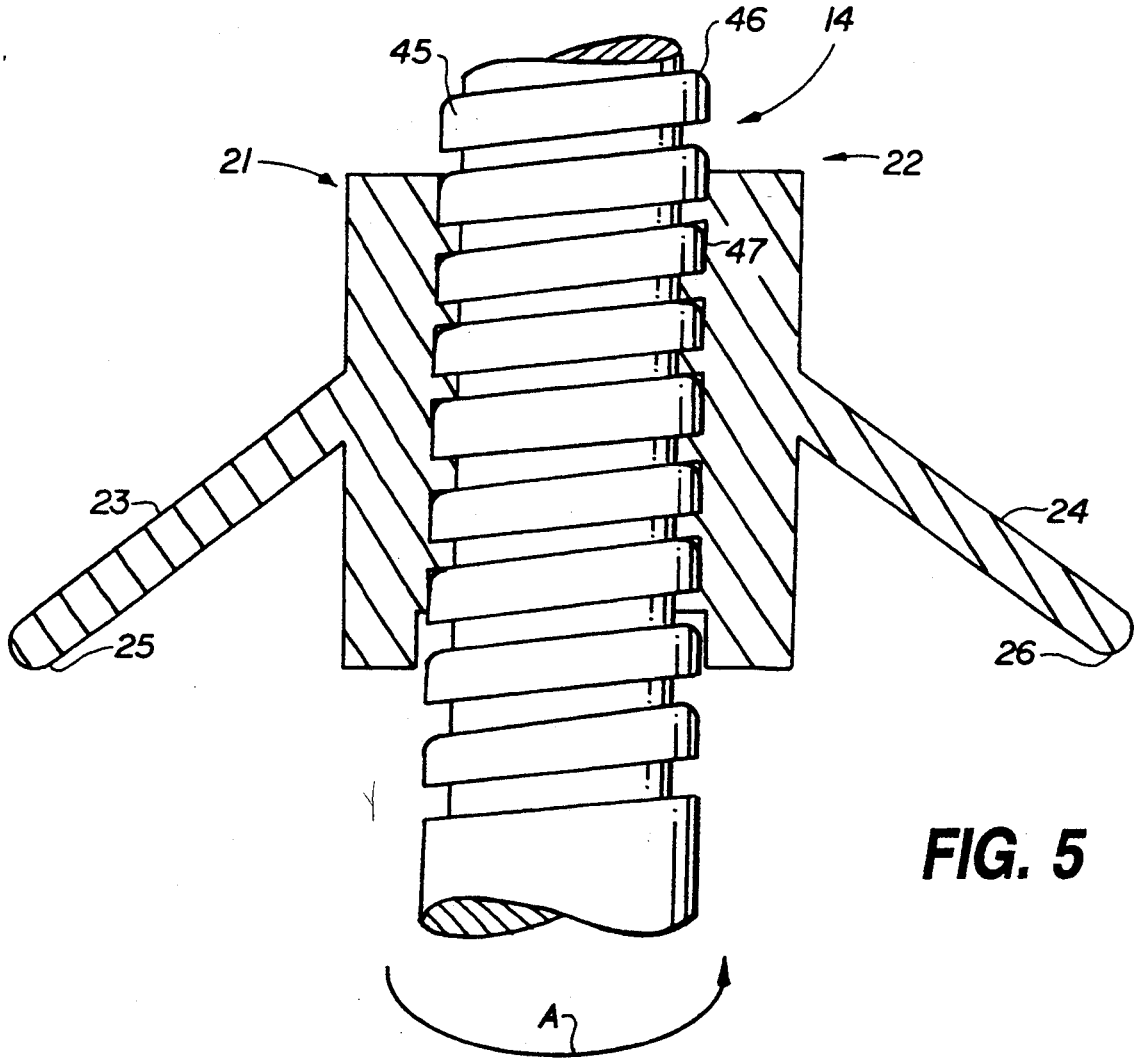
FIG. 5 is an enlarged section view illustrating the engagement of the screw with the internally threaded arms of the C-clamp of FIGS. 1 to 3.
Figure 6:
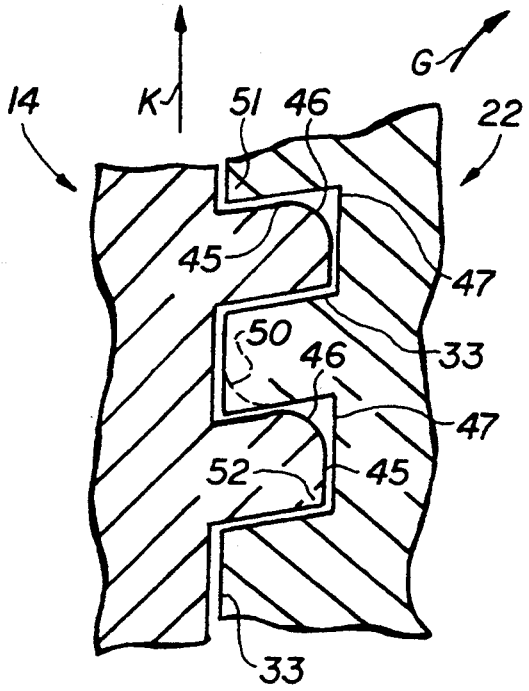
FIG. 6 is an enlarged section view illustrating the engagement of the screw with one of the internally threaded arms of the C-clamp of the invention; and, FIG. 7 is an enlarged view illustrating the mode of operation of the latch which maintain the internally threaded members in an open position.

If in FIG. 1, workpiece 60 is removed and screw 13 is manually pushed upwardly toward anvil 11 in the direction of arrow K, members 21 and 22 pivot from the position shown in FIG. 1 in the directions of arrows F and G to the position shown in FIG. 3 to permit screw 13 to slide freely upwardly intermediate members 21 and 22 until foot 12 contacts anvil 11. This outward pivoting of members 21 and 22 in the directions of arrow F and G is possible because the upper corner of continuous thread 45 on screw 13 is rounded 46 in the manner illustrated in FIGS. 5 and 6. If the upper corner were not rounded 46, but remained in a normal "squared" configuration similar to that of lower continuous edge or corner 52 of thread 45, then members 21 and 22 could not pivot outwardly in the direction of arrows F and G because, for example, the thread 45 would interlock with the thread 33 of member 22 and prevent the lateral movement of member 22 in the direction of arrow G. Instead of rounding the upper corner 46 of thread 45, the lower corner 51 of thread 33 can be rounded in the manner indicated by dashed line 50 in FIG. 6 or threads 45, 32, 33 can be shaped, contoured, and dimensioned in any desirable manner which permits the members 21 and 22 to move outwardly in the direction of arrows F and G when screw 13 is upwardly pressed in the direction of arrow K to move foot 12 toward anvil 11. Once members 21 and 22 reach the position shown in FIG. 3, latch 18 can be upwardly displaced in the direction of arrow C to the position shown in FIG. 7 and by dashed lines 70 in FIG. 3.

Figure 4:
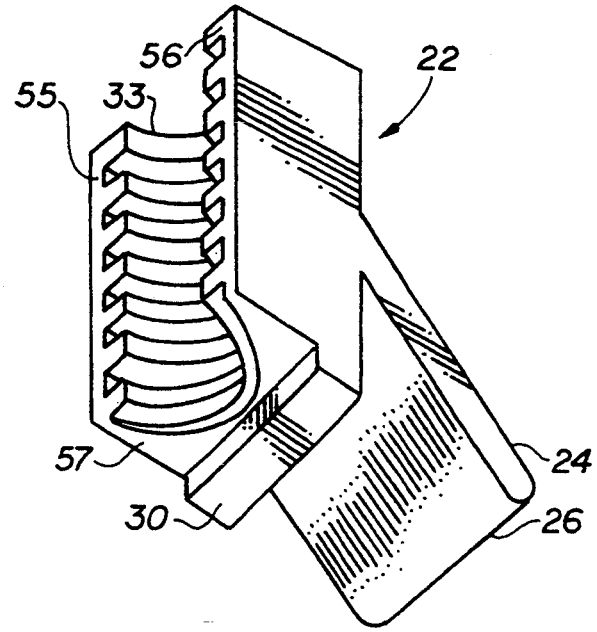
FIG. 4 is a perspective view illustrating one of the pivoting internally threaded arms of the C-clamp of FIGS. 1 to 3.

If desired, only one of members 21 and 22 need be internally threaded and pivot outwardly when screw 13 is upwardly moved in the direction of arrow K. For example, in FIG. 1 member 21 can be fixed permanently in position and be provided with a smooth non-threaded semi-cylindrical surface in place of thread 32. Screw 13 would freely slide over this smooth semi-cylindrical surface. Member 22 would still, however, have the threaded configuration shown in FIGS. 2, 3, and 4 and screw 13 would cause member 22 to outwardly pivot in the direction of arrow G (FIG. 3) when screw 13 was moved in the direction of arrow K in FIG. 3. In this configuration, latch 18 would be appropriately configured only to contact and maintain in position member 22 when member 22 is in the position shown in FIG. 3.

In use, screw 13 of the C-clamp of FIG. 1 can be turned in a direction opposite that indicated by arrow A to unthread screw 13 in the direction of arrow R through the internally threaded aperture defined by threads 32 and 33 of abutting members 21 and 22. Alternately, latch 18 can be pressed upwardly in the direction of arrow C to force members 21 and 22 to the second operative position of FIG. 3 so that screw 13 can freely slide intermediate members 21 and 22 in the directions indicated by arrows K and R. After screw 13 is moved the desired distance in the direction of arrow R, a workpiece 60 is placed intermediate foot 12 and anvil 11. The end 15 and rod 16 are manually grasped and pushed upwardly in the direction of arrow K, causing members 21 and 22 to open outwardly in the direction of arrows F and G such that screw 13 slides upwardly intermediate members 21, 22 in the direction of arrow K in FIG. 3. Moving screw 13 upwardly in the direction of arrow K generates upward forces which overcome the opposing forces generated by tensioned springs 27 and 28 and outwardly displaces members 21, 22 in the direction of arrows F and G. After screw 13 is slid upwardly in the direction of arrow K a sufficient distance to place foot 12 adjacent and/or contacting the workpiece 60 with workpiece adjacent and/or contacting anvil 11, latch 18 is (if necessary) slid in the direction of arrow Q to the position shown in FIG. 1, and screw 13 is moved a short distance in the direction of arrow R to permit members 21 and 22 to move from the second operative position illustrated in FIG. 3 to the first operative position illustrated in FIG. 1. Moving screw 13 downwardly in the direction of arrow R permits springs 27 and 28 to pull members 21 and 22 inwardly toward one another to the first operative position shown in FIG. 1 (assuming latch 18 is in the position shown in FIG. 1 and does not interfere with movement of members 21, 22 from the position shown in FIG. 7 to the position shown in FIG. 1). When screw 13 is downwardly displaced, thread 45 also contacts threads 32 and 33, providing additional impetus for moving members 21 and 22 inwardly toward one another from the second operative position illustrated in FIG. 3. Once members 21 and 22 are closed to the first operative position, end 15 and rod 16 are grasped and turned in the direction of arrow A to tighten foot 12 against workpiece 60 and compress workpiece 60 intermediate foot 12 and anvil 11. When it is time to remove the C-clamp of FIG. 1 from workpiece 60, end 15 and rod 16 can be grasped and turned in a direction opposite that of arrow A to "back off" foot 12 from workpiece 60, after which workpiece 60 is pulled free from the C-clamp or, instead, the C-clamp is pulled from workpiece 60. Also, when it is time to remove the C-clamp from workpiece 60, L-shaped latch 18 can be upwardly slid in the direction of arrow C (FIG. 3) to force members 21 and 22 apart from the first operative position of FIG. 1 to the second operative position of FIG. 3. Once members 21 and 22 are maintained by latch 18 in the second operative position, screw 13 is freely slid downwardly in the direction of arrow R.

Having described my invention in such terms as to enable those skilled in the art to understand and practice it and having described the presently preferred embodiments thereof,

I Claim:

1. An improved C-clamp including (a) a C-shaped body having a first end terminating in an anvil and a second end, said second end including (i) a base, (ii) first and second opposing members mounted in said base, said first member being internally threaded and pivotally mounted in said base for movement between two operative positions, a first operative position with said first member adjacent said second member such that said first and second members define an aperture internally threaded to receive a U-shaped thread, and a second operative position with said first member displaced apart from said second member, (iii) an opening formed through said base;

(b) a screw including a foot and extending through said opening and having an external U-shaped thread with top and bottom corners, said external thread capable of axially threading through said internally threaded aperture when said first member is in said first operative position, said external thread being sloped with respect to the direction of travel of said screw toward and away from said base and at least one of said corners being rounded such that when said first member is in said first operative position with (i) said external thread contacting said internally threaded aperture, and (ii) said foot spaced apart from said anvil, the application to said screw of a displacement force acting to displace said foot toward said anvil causes said first member to pivot away from said screw to said second operative position such that said screw can slide intermediate said first and second members upwardly toward said anvil.

2. The C-clamp of Claim 1 wherein said second member is pivotally mounted in said base and is internally threaded to receive a U-shaped thread.

3. An improved C-clamp including (a) a C-shaped body having a first end terminating in an anvil and a second end including;

(i) a base having a contact surface (31) at an angle to said longitudinal axis, (ii) first and second opposing internally threaded members (21,22) mounted in said base at fixed pivot points for movement between two operative positions, a first operative position with said first and second members contacting one another and defining an internally threaded aperture, and a second operative position with said first and second members displaced apart from one another, (iii) an opening formed through said base;

(b) a screw having a longitudinal axis including a foot (12) and extending through said opening and having an external thread capable of axially threading through said internally threaded aperture when said first and second members are in said first operative position, said first and second members each having a foot (29,30) and being shaped and dimensioned such that when (i) said first and second members are in said first operative position, (ii) said foot (12) of said screw presses a workpiece against said anvil, and (iii) said foot (12) of said screw is further tightened against said workpiece, at least one of said feet (29,30) of said first and second members is forced against said contact surface (31) of said base (17) in a direction away from said anvil, said foot (12) of said screw, and said workpiece.

4. An improved c-clamp including (a) a C-shaped body having two ends, a first end terminating in an anvil and a second end including;

(i) a base, (ii) a first threaded member (21) with at least one face (53,54) and a second threaded member (22) with at least one face (55,56) and opposed to said first member (21), said opposing members (21,22) being mounted in said base at fixed pivot points for movement between two operative positions, a first operative position with said first and second members contacting one another and defining an internally threaded aperture, and a second operative position with said first and second members displaced apart from one another, (iii) an opening formed through said base;

(b) a screw including a foot and extending through said opening and having an external thread capable of axially threading through said internally threaded aperture when said first and second members are in said first operative position, said first and second members being shaped and dimensioned such that when (i) said first and second members are in said first operative position, (ii) said foot presses a workpiece against said anvil, (iii) said foot is further tightened against said workpiece, said face of said first member is forced against said face of said second member.

5. An improved C-clamp including (a) a C-shaped body having a first end terminating in an anvil and a second end, said second end including (i) a base, (ii) first and second opposing members mounted in said base, said first member being internally threaded and pivotally mounted in said base for movement between two operative positions, a first operative position with said first member adjacent said second member such that said first and second members contact one another and define an aperture internally threaded to receive a U-shaped thread, and a second operative position with said first member displaced apart from said second member, said a U-shaped thread having a rounded top corner and a bottom corner, (iii) an opening formed through said base;

(b) a screw including a foot and extending through said opening and having an external U-shaped thread capable of axially threading through said internally threaded aperture when said first member is in said first operative position, said external and internal threads being sloped with respect to the direction of travel of said screw toward and away from said base, said top corner of said internal U-shaped thread being rounded such that when said first and second members are in said first operative position with (i) said external thread contacting said internally threaded aperture, and (ii) said foot spaced apart from said anvil, the application to said screw of a displacement force acting to displace said foot toward said anvil causes said first member to pivot away from said screw to said second operative position such that said screw can slide intermediate said first and second members upwardly toward said anvil.

6. The C-clamp of Claim 1 including a latch (18) movably mounted on said base and, when said first member is in said second operative position, movable to a position intermediate with and contacting said first and second opposing members to prevent said first member from moving from said second operative position to said first operative position.

7. The C-clamp of Claim 3 including a latch (18) movably mounted on said base and, when said first and second opposing members are in said second operative position, movable to a position intermediate with and engaging said first and second opposing members to prevent said first and second opposing members from moving from said second operative position to said first operative position.

8. The C-clamp of Claim 4 including a latch (18) movably mounted on said base and, when said first and second opposing members are in said second operative position, movable to a position intermediate with and engaging said first and second opposing members to prevent said first and second opposing members from moving from said second operative position to said first operative position.

9. The C-clamp of Claim 5 including a latch (18) movably mounted on said base and, when said first member is in said second operative position, movable to a position intermediate with and engaging said first and second opposing members to prevent said first member from moving from said second operative position to said first operative position.

10. The C-clamp of Claim 6 wherein said foot (12) is shaped and dimensioned to, when said first member is in said second operative position and said screw is pulled away from said anvil, move intermediate said first and second opposing members and separate said first and second members from contact with said latch.

11. The C-clamp of Claim 7 wherein said foot (12) is shaped and dimensioned to, when said first and second opposing members are in said second operative position and said screw is pulled away from said anvil, move intermediate said first and second opposing members and separate said first and second members from contact with said latch.

12. The C-clamp of Claim 8 wherein said foot (12) is shaped and dimensioned to, when said first and second opposing members are in said second operative position and said screw is pulled away from said anvil, move intermediate said first and second opposing members and separate said first and second members from contact with said latch.

13. The C-clamp of Claim 9 wherein said foot (12) is shaped and dimensioned to, when said first member is in said second operative position and said screw is pulled away from said anvil, move intermediate said first and second opposing members and separate said first and second members from contact with said latch.

* * * * *